US005817996A

United States Patent [19]

Ulrich et al.

[11] Patent Number: 5,817,996

[45] Date of Patent: Oct. 6, 1998

[54] MULTI-FUNCTIONAL ELECTRICAL SWITCH ASSEMBLY WITH MOMENTARY OPERATING MECHANISM

[75] Inventors: Frank Alfred Ulrich, Dillsburg; Klaus Titzrath, Wellsville, both of Pa.

[73] Assignee: Mavell Corporation, Dillsburg, Pa.

[21] Appl. No.: 806,517

[22] Filed: Feb. 24, 1997

[51] Int. Cl.[6] ..... H01H 3/00; H01H 9/00

[52] U.S. Cl. ..... 200/4; 200/5 R; 200/18

[58] Field of Search ..... 200/1 R, 5 R, 200/4, 5 A, 6 R, 6 A, 8 R, 8 A, 11 R, 14, 17 R, 18, 298, 303, 553, 557, 573

[56] References Cited

U.S. PATENT DOCUMENTS

| | | | |
|---|---|---|---|
| 2,305,185 | 12/1942 | Merkel | 200/4 |
| 2,779,827 | 1/1957 | Broen et al. | 200/4 |
| 3,539,736 | 11/1970 | Naimer | 200/4 |
| 4,518,832 | 5/1985 | Geremia | 200/4 |
| 4,616,115 | 10/1986 | Potyka | 200/6 A |
| 4,626,699 | 12/1986 | Oesterle et al. | 200/30 R |
| 5,140,111 | 8/1992 | Vultaggio et al. | 200/4 |
| 5,264,821 | 11/1993 | Vultaggio et al. | 338/172 |
| 5,491,311 | 2/1996 | Muscat et al. | 200/4 |

OTHER PUBLICATIONS

Entech Corporation catalog, Series 4000 Railroad Signal Controller Switch. Four pages.

*Primary Examiner*—J. R. Scott
*Attorney, Agent, or Firm*—James M. Trygg

[57] ABSTRACT

A multi-function electrical switch assembly (22) is disclosed that is mountable to a mosaic control panel (12) used in the controlling and monitoring of large complex traffic flow systems. The switch assembly has a bi-directional actuating mechanism including a shaft (24) that is movable axially as well as rotationally to actuate individual electrical switches (110, 112, 114, 115, 118, 120, 122, and 124). The switch assembly includes a housing (30) having an interior cavity (56) and interior walls (36, 46) to which individual switches are secured. The shaft (24) extends through the interior cavity (56) and has a rocker cam (224) and a linear cam (254) coupled thereto for actuation of various combinations of the switches. Return spring units (202) and (168) return the shaft (24) to its rotational and axial neutral positions when the shaft is released. An override spring unit (244) is coupled to the rocker cam (224) to absorb over-rotation of the shaft (24) and prevent damage to the switch mechanism.

28 Claims, 10 Drawing Sheets

254
272
268
262
258
270
256
260
266
264

36
224
192
48
38
278
268
266
280
254
122
124
110
118
112
120
40

190
36
224
122
124
278
110
118
268
266
112
120
280
254
40
38

254
278
256
264
258
266
262
270
260
280
258

254
256
258
264
278
278
260
266
268
262
280
258
280

MULTI-FUNCTIONAL ELECTRICAL SWITCH ASSEMBLY WITH MOMENTARY OPERATING MECHANISM

The present invention relates to an electrical switch assembly that is mountable to a control panel used in the controlling and monitoring of large complex traffic flow systems, such as rail road systems, and more particularly to such a switch assembly having a bi-directional actuating mechanism and multi-function switch elements.

BACKGROUND OF THE INVENTION

Control panel systems are currently used to control and monitor traffic flow in large rail road systems as well as other similar systems. While the present invention can be advantageously utilized in other types of traffic flow systems, rail road systems conveniently illustrate the important advantages of the present invention and, therefore, will be used as an example herein. Such large complex rail road systems include, among other things, sensors for detecting the presence of rail road cars and engines on particular track segments, signals for regulating the actual flow of traffic along these tracks, remotely actuated track switching mechanisms for altering the path of traffic flow, and various other sensors and signaling devices for monitoring and controlling the efficient operation and safety of the system. The current status of all of these sensors, signals, and switching mechanisms is displayed on a large display panel through indicator lights, display screens, and other instruments. Additionally, several multi-function switch assemblies, the subject of the present invention, are positioned in strategic locations on the panel for use in operator control of the system. The physical layout of the track and related facilities is schematically represented on the outer face of the panel which is usually a mosaic panel composed of hundreds of small tiles that are attached to a grid structure. However, other panel structures are utilized as well. In the case of mosaic panels, each tile includes a tiny portion of the schematic layout. Some of the tiles include the indicator lights and other instruments while other tiles include the multi-function switch assemblies used in controlling the system. Each of these switch assemblies typically has a relatively large elongated housing attached to the grid structure behind a specific tile, the operating shaft of the switch extending through an opening in the tile. The switch housing is considerably larger than a single tile, therefore, each installed switch must be surrounded by tiles not containing switches, indicator lights, or other instruments. This, of course, limits the useful density of switches on the panel. Additionally, these switch assemblies typically utilize individual leaf spring switch elements attached to and clustered about an insulated central structure. A central actuating shaft includes cam elements that deflect selected leaf springs to cause pairs of electrical contacts to close or open, as desired. The leaf springs simply move the pairs of contacts laterally into engagement without any wiping or snap action. This, of course, may result in somewhat unreliable conductivity through the closed pairs of contacts and resulting failure of the desired control function. Further, the leaf springs tend to fatigue after only moderate use resulting in a relatively short life for these switch assemblies. This switch structure contributes to the large size of the switch assembly making it difficult to provide high density groupings of switches where desired. Additionally, these typical switch assemblies can only accommodate four single pole, double throw switch elements, all of which are needed to perform the primary functions that are communicated through a computer control system. A backup system is provided so that, in the event of a computer failure, the switch assemblies on the panel are still effective in the control of the system functions. This requires relay switching circuits that can disconnect the panel switch assemblies and other instruments from the primary system and reconnect them to the backup system, which adds to the expense and complexity of the system.

What is needed is a multi-function switch assembly that is small enough to fit within the physical limitations of a single tile so that adjacent tiles may accommodate switch assemblies as well as indicators and other instruments, thereby enabling a higher component density in any desired location on the panel. The switch elements should have a snap action to provide superior electrical contact and increased reliability and service life. Further, the switch assembly should contain a sufficient number of individual electrically isolated switch elements to accommodate both the primary functions that are communicated through the computer control system as well as a backup system.

SUMMARY OF THE INVENTION

A momentary switch assembly is provided for use in a control panel. The switch assembly includes an elongated housing having at least two side walls and ends defining an interior cavity. A shaft extends through one of the ends and into the interior cavity along a longitudinal axis. The shaft is arranged to move axially in a first direction with respect to the housing from a first neutral position and in a second opposite direction from the first neutral position. Additionally, the shaft is arranged to rotate about the axis in a third direction with respect to the housing from a second neutral position and in a fourth opposite direction from the second neutral position. First and second mutually independent electrical switches are provided, each of which is attached to one of the side walls of the housing within the cavity. The first and second switches are coupled to the shaft by a first coupling so that movement of the shaft in the first direction actuates only the first switch and movement of the shaft in the second direction actuates only the second switch. Third and fourth mutually independent electrical switches are provided, each of which is attached to one of the side walls of the housing within the cavity. The third and fourth switches are coupled to the shaft by a second coupling so that movement of the shaft in the third direction actuates only the third switch, and movement of the shaft in the fourth direction actuates only the fourth switch. Means is also provided for urging the shaft into the first and second neutral positions.

DESCRIPTION OF THE FIGURES

FIGS. 2, 3, 4, and 5 are side, top, left end, and right end views, respectively, of the switch assembly shown in FIG. 1;

FIG. 9 is a partial exploded parts view of the switch housing;

DESCRIPTION OF THE PREFERRED EMBODIMENT

Figure 1:
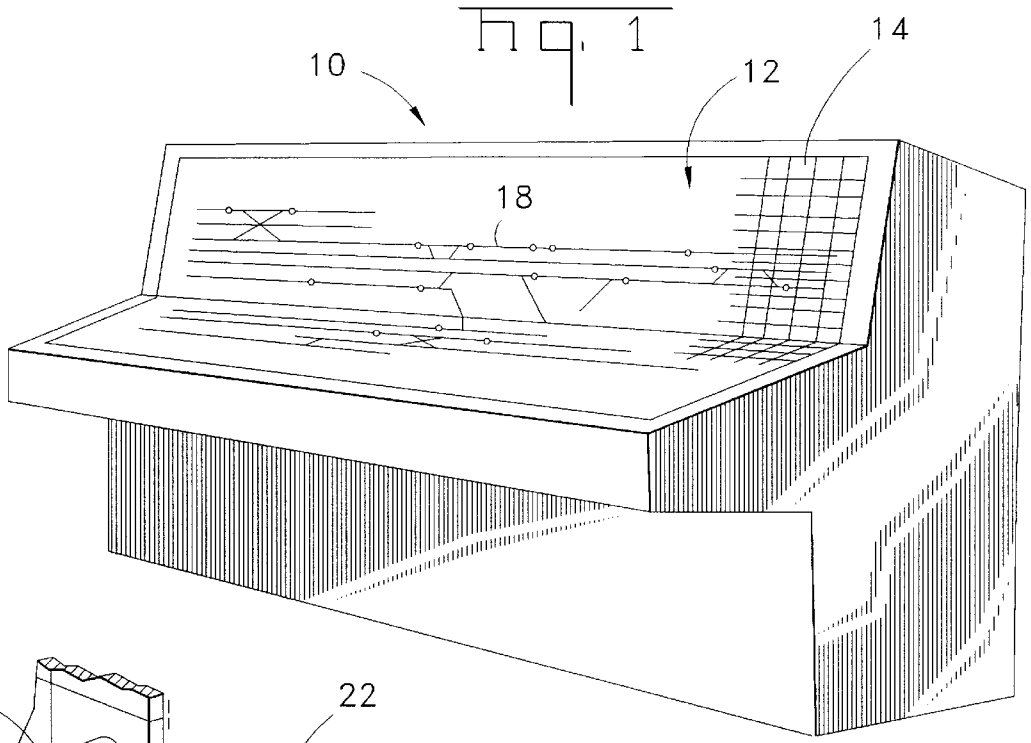
FIG. 1 is an isometric view of a mosaic panel control console incorporating the teachings of the present invention.
Figure 1A:
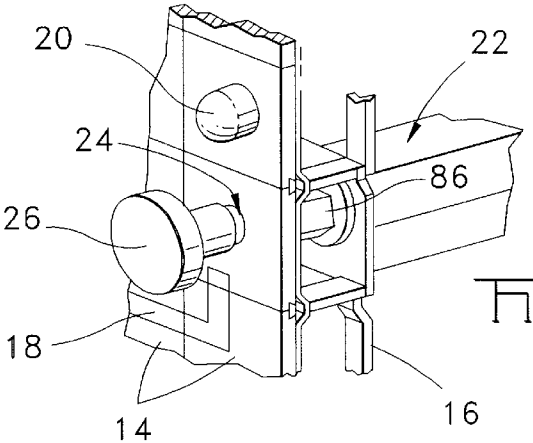
FIG. 1A is an isometric view of a portion of the mosaic panel shown in FIG. 1 and its supporting grid structure.

There is shown in FIG. 1 a control console 10 for controlling and monitoring large complex traffic flow systems, in the present example, a rail road system. The control console 10 includes a large mosaic panel 12 composed of many individual tiles 14 supported on a grid structure 16 that forms the frame of the control console 10. A pattern 18 is formed on the outer surfaces of the tiles 14 thereby forming a schematic representation of the rail road system including all of its track segments, track switching mechanisms, control lights, and sensors. Each tile 14 is easily removable from the grid structure and replaced with a new tile having a different pattern should a change in the layout become desirable. Some of the tiles 14 include indicator lights 20, as shown in FIG. 1A, and other instruments that indicate present status of the various components of the rail road system. Others of the tiles 14 include electrical switch assemblies 22 attached to the grid structure 16 directly behind the tile so that the switch actuating shaft 24 extends through the tile, as shown in FIG. 1A. A knob 26 is attached to the end of the shaft 24 in the usual manner for manually operating the switch.

Figures 1, 2, 4, 5:
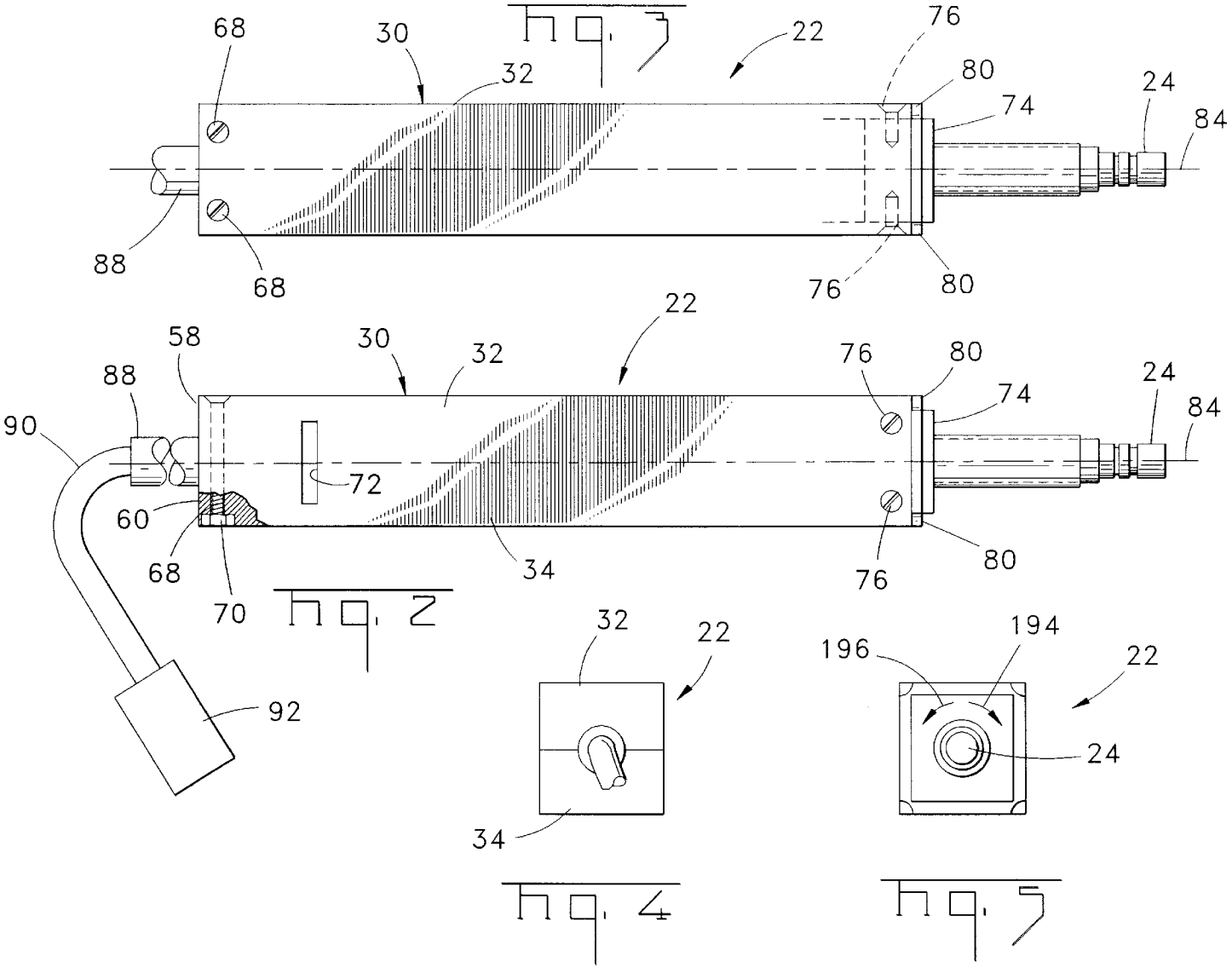
Figure 6:
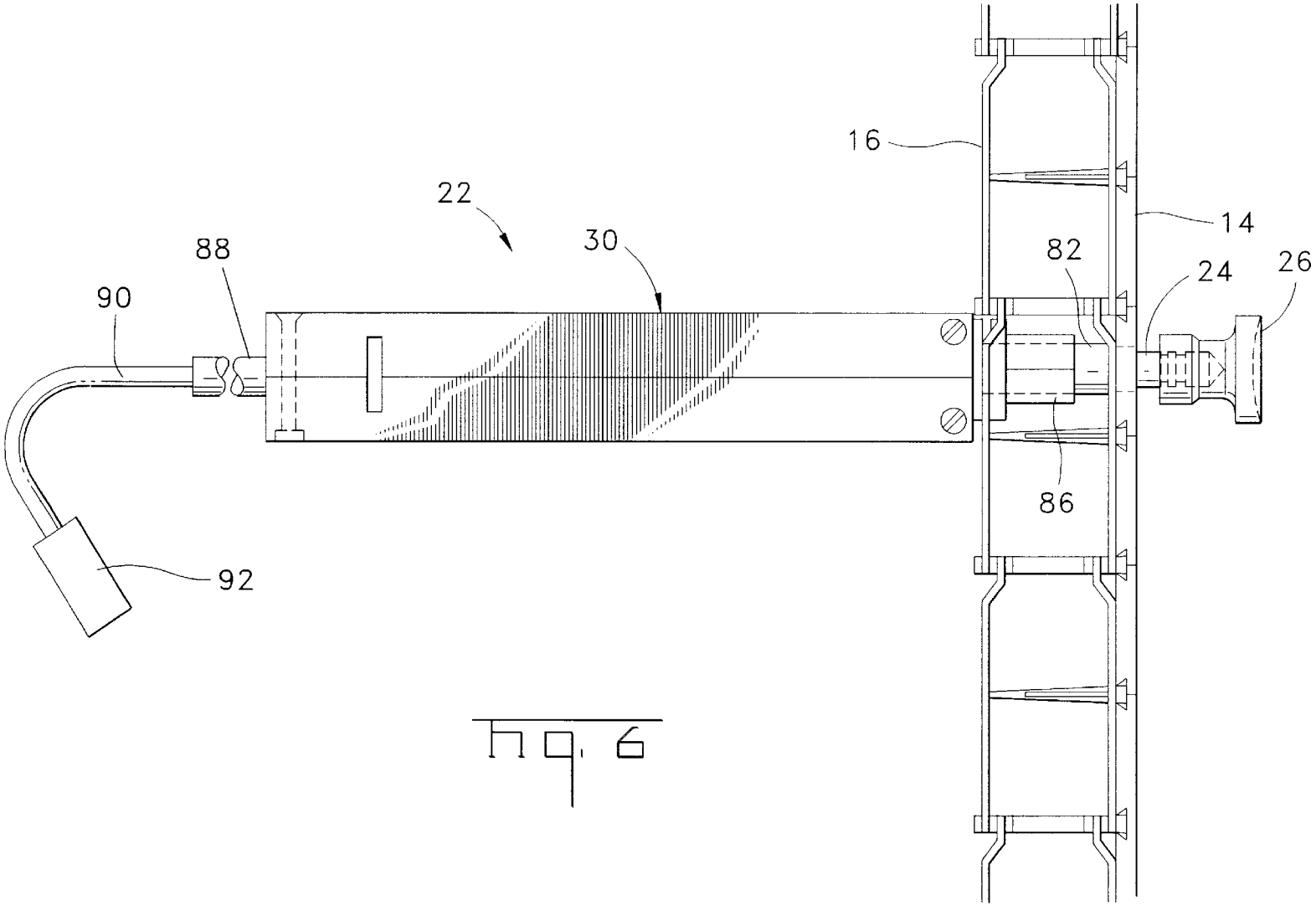
FIG. 6 is a cross-sectional view taken along the lines 6—6 in FIG. 1 showing the attachment of the switch assembly to the panel structure.
Figure 7:
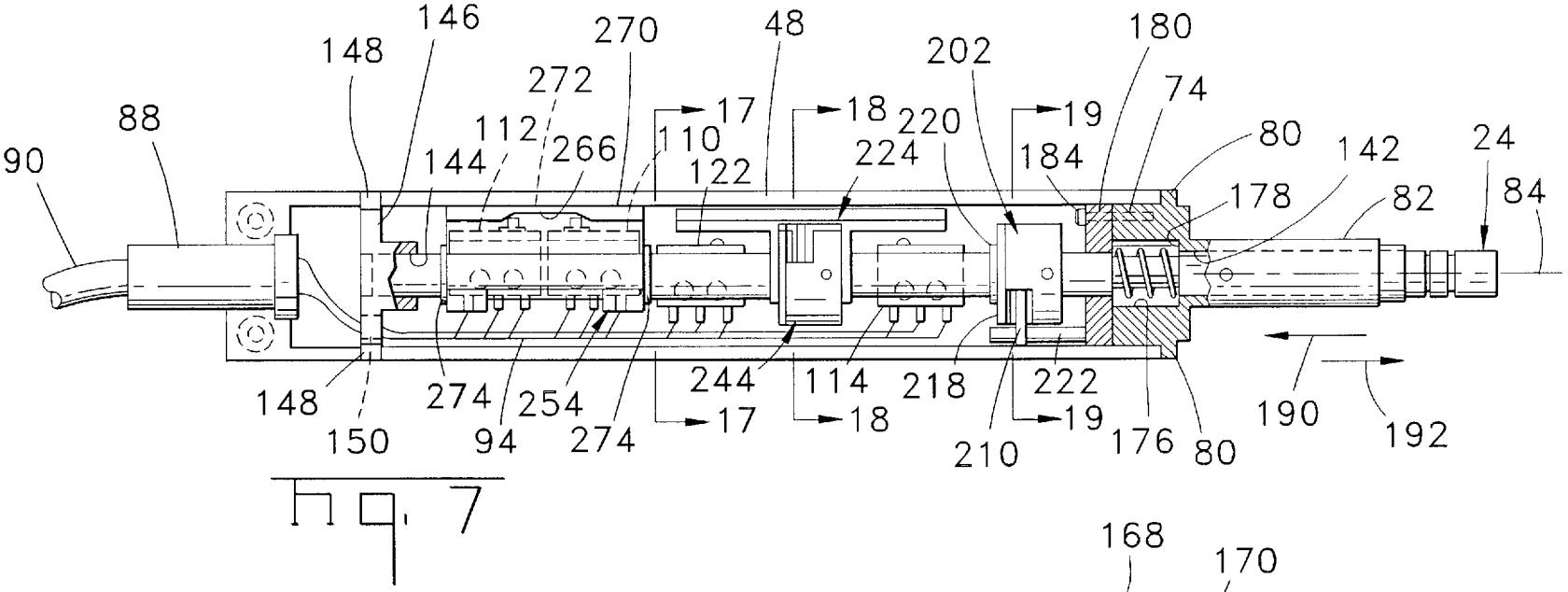
FIG. 7 is a top view similar to that of FIG. 3 with one housing half removed.

The switch assembly 22, as shown in FIGS. 2, 3, 4, and 5, includes a two part box-shaped housing 30 composed of an upper housing half 32 and a lower housing half 34. The upper housing half 32, as best seen in FIG. 9, has an upper wall 36 and left and right side walls 38 and 40, respectively. A rabbet 42 extends along most of the inside edge of the left wall 38 and a similar rabbet 44 extends along most of the outside edge of the right wall 40. Similarly, the lower housing half 34, as best seen in FIG. 9, has a lower wall 46 and left and right side walls 48 and 50, respectively. A rabbet 52 extends along most of the outside edge of the left wall 48 and a similar rabbet 54 extends along most of the inside edge of the right wall 50. When the two housing halves 32 and 34 are joined to form the housing 30 the rabbets 42 and 52 overlap and the rabbets 44 and 54 overlap to help form a dust free interior cavity 56. Each of the housing halves has a closed end 58 and 60, respectively, with a counterbored hole 62 formed therein for a purpose that will be explained. Two countersunk screw holes 64 are formed through the closed end 58, as shown in FIG. 9, and aligned screw holes 66 are formed through the closed end 60. Two flat head screws 68 extend through the holes 64 and 66 and into nuts 70 that are disposed in hexagonal recesses formed in the closed end 60, as best seen in FIG. 2. Mutually aligned rectangular slots 72 are formed in both left side walls 38 and 48 and both right side walls 40 and 50 for a purpose that will be explained. The other end of the housing 30 is secured to a rectangular shaped block 74 that is a close fit with the interior cavity 56, as best seen in FIG. 7. Note that FIG. 7 is a view of the switch assembly similar to that of FIG. 3 with the upper housing half 32 removed. Four flat head screws 76 extend through countersunk clearance holes 78 in the side walls 38, 40, 48, and 50 and into threaded holes in the block 74, as shown in FIGS. 2 and 3. The block 74 includes four flanges 80 which abut the ends of the side walls 38, 40, 48, and 50, as shown in FIG. 7. The block 74 includes a threaded diameter 82 extending outwardly along the longitudinal axis 84 of the switch assembly 22, as shown in FIG. 7, and through an opening in the grid structure 16, as shown in FIG. 6. A nut and washer assembly 86 is threaded onto the threaded diameter 82 to secure the switch assembly to the grid structure 16. A cable strain relief grommet 88 is arranged within the counterbored hole 62 and held in place by compressive forces caused by the screws 68. An electrical cable 90 extends from the strain relief grommet 88 and terminates in an electrical connector 92 that interconnects individual switches of the switch assembly 22 to the rest of the control console system. Some of these switches are interconnected to the primary control system and others are interconnected to the backup control system, as will be explained.

Figure 9A:
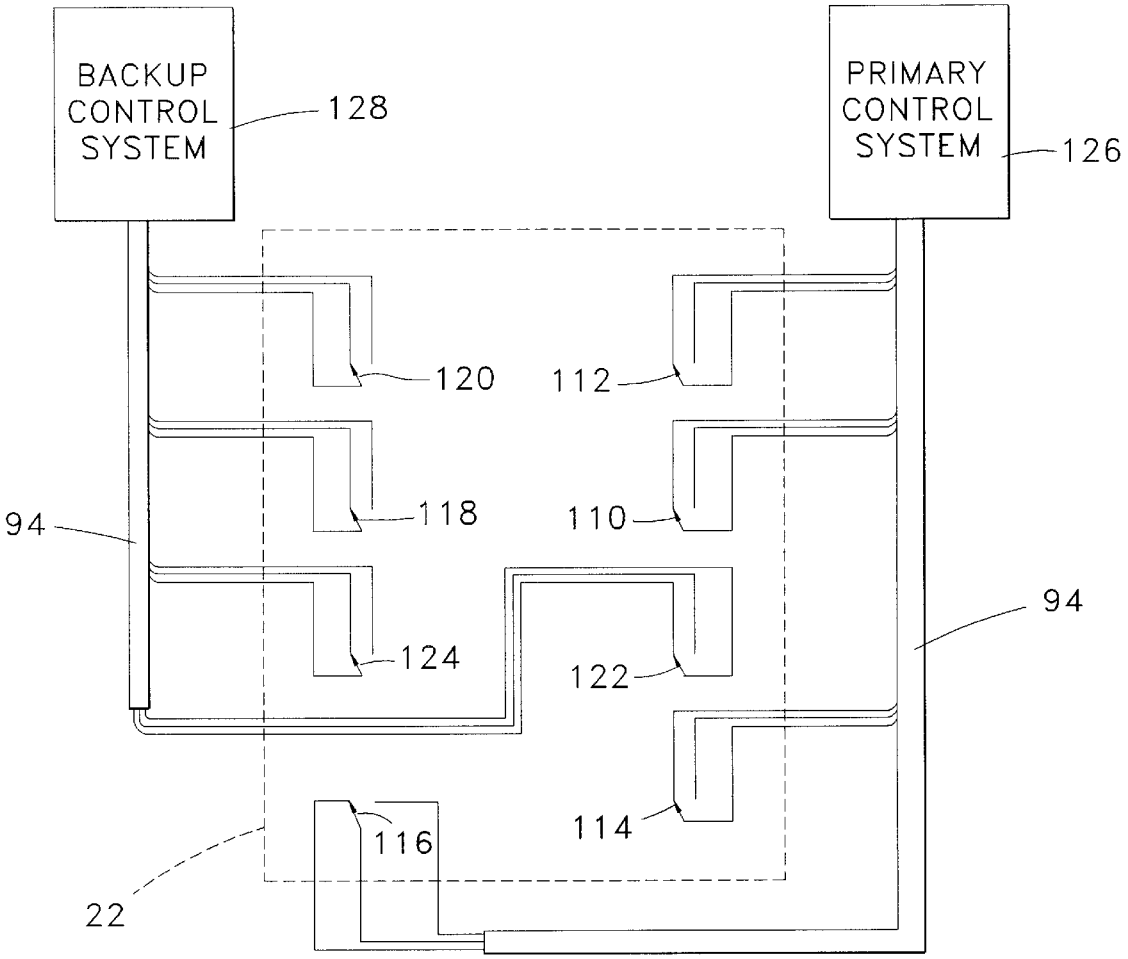
FIG. 9A is a schematic diagram showing the various interconnections of the switch elements of the switch assembly shown in FIG. 2.

As shown in FIG. 7, the cable 90 includes electrical wires 94 that interconnect to the terminals of several individual enclosed electrical switches. These electrical switches, as best seen in FIG. 9, are within the interior cavity 56 and are secured to the upper and lower walls 36 and 46 by means of posts that are molded with or otherwise attached to the walls. The posts extend through holes in the electrical switches and are heat staked to hold the switches in place. Of these switches there are first, second, third, and fourth primary switches 110, 112, 114, and 116, respectively, which are interconnected to a primary control system 126 that performs the primary control functions of the system. Additionally, there are fifth, sixth, seventh, and eighth backup switches 118, 120, 122, and 124, respectively which are interconnected to a backup system 128, as shown in FIG. 9A, so that in the event of a failure of the primary system, the backup system can be enabled and the switch assemblies 22 on the mosaic panel 12 will remain effective in the control of the system functions. As best seen in FIG. 9, the primary switches 110, 112, and 114 and the backup switch 122 are secured to the lower wall 46 of the lower half 34, and the primary switch 116 and the backup switches 118, 120, and 124 are secured to the upper wall 36 of the upper half 32. Each of the switches 110 through 124 is a single pole double throw switch having a fully enclosed housing and a snap-action type switch element such as, for example, model number 11SX21-T which is manufactured by Micro-Switch Honeywell Inc. of 11 West Spring Street, Freeport, Ill. 61032.

Figure 8:
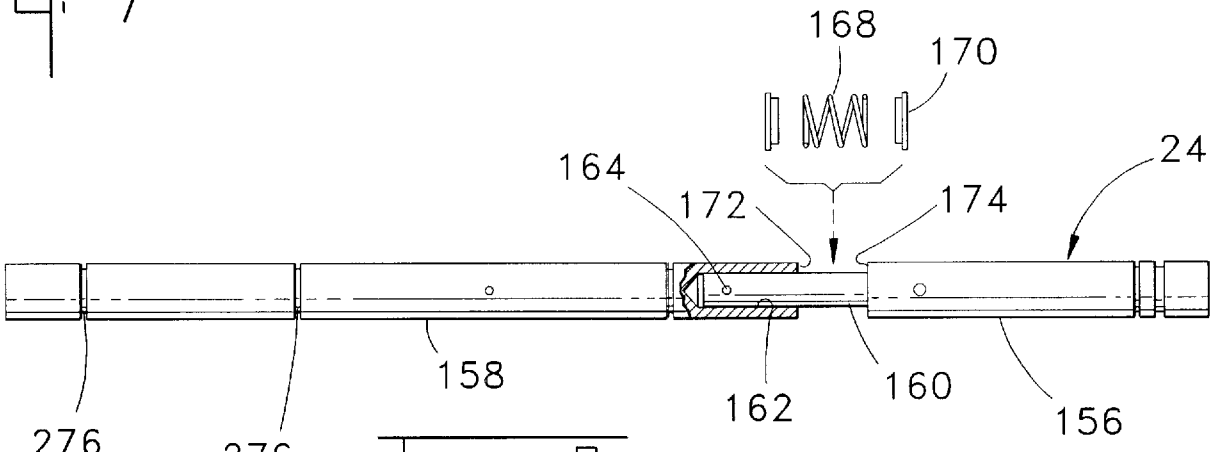
FIG. 8 is a plan view of the actuating shaft.
Figure 7:
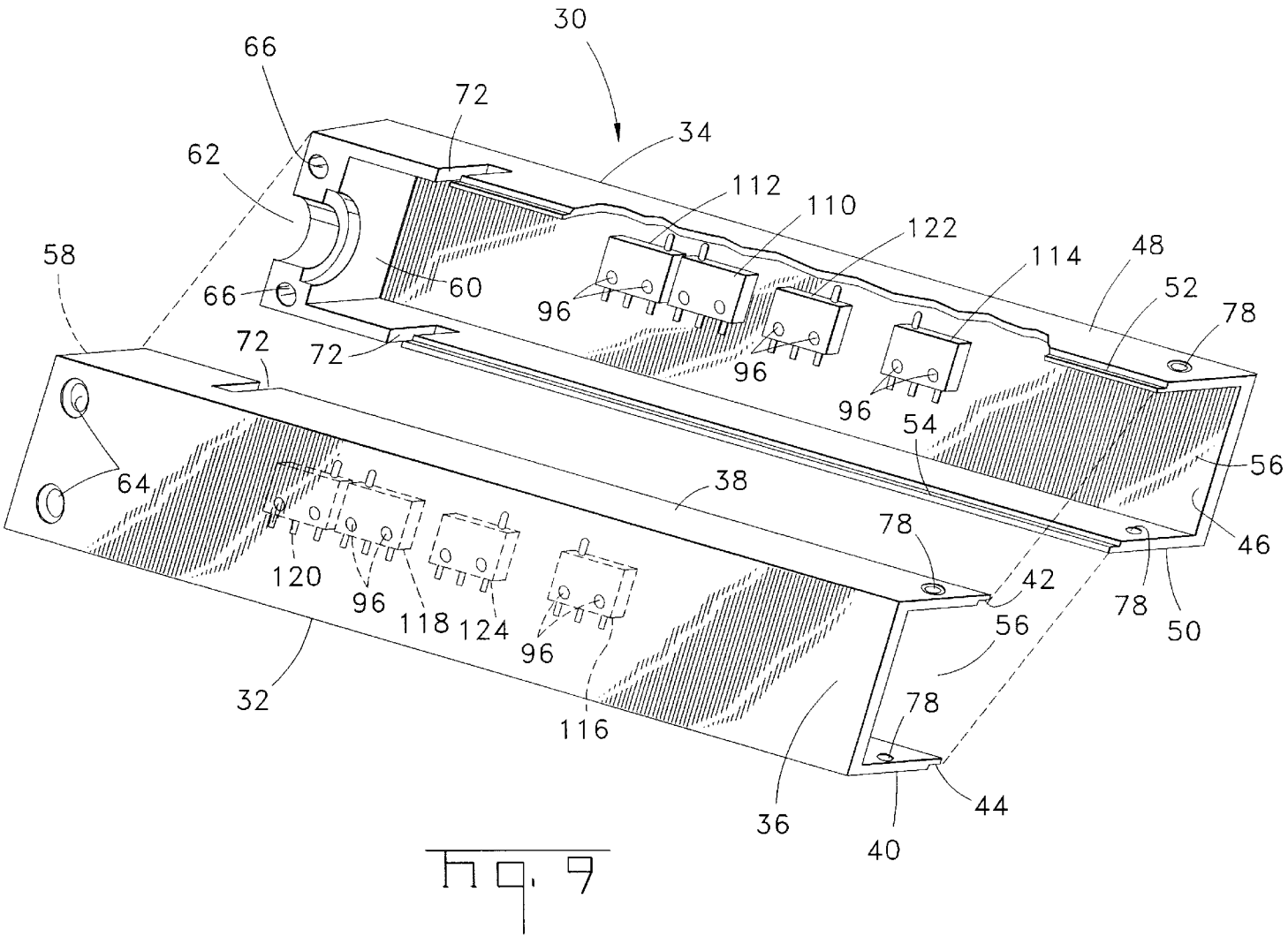
Figure 10:
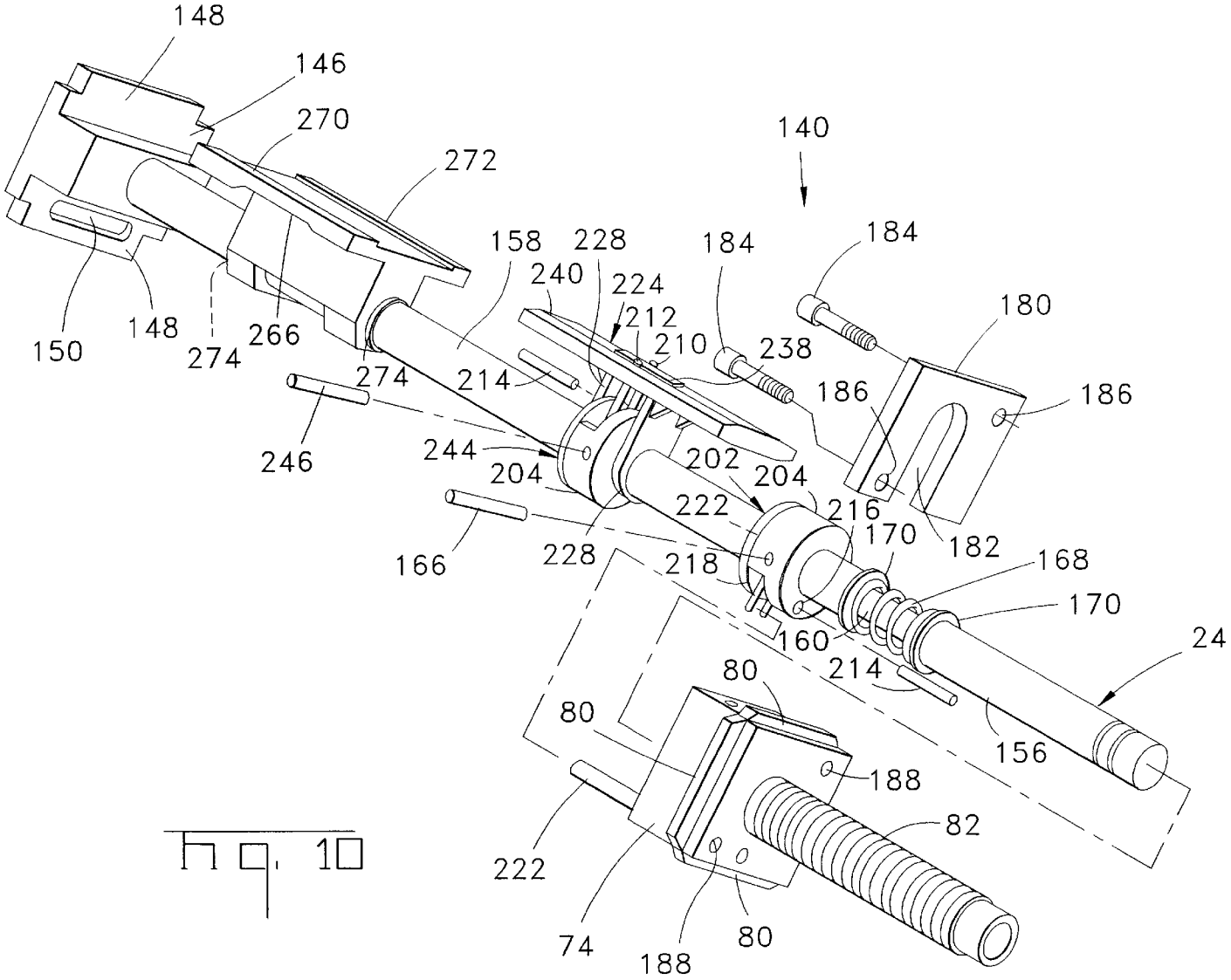
FIG. 10 is an isometric view of the shaft assembly.

The switches 110 through 124 are actuated by a shaft assembly 140, as best seen in FIGS. 7 and 10. The shaft assembly includes the shaft 24 having one end that is a loose slip fit with a bore 142 that is formed through the block 74 and threaded diameter 82, and the other end that is a loose slip fit within a bore 144 of a support member 146. The support member 146 is sized to fit snugly within the interior cavity 56 and includes two oppositely formed flanges 148 that extend through the slots 72 in the left and right side walls 38, 48, 40, and 50, thereby supporting the free end of the shaft 24. An elongated opening 150 is formed through the support member 146, as shown in FIG. 10, to provide a passageway through which the wires 94 pass. As best seen in FIG. 8, the shaft 24 is composed of a first portion 156 and a second portion 158 that are interconnected by a reduced diameter 160 extending from the first portion into a bore 162 formed in the second portion. A hole 164 extends through both the second portion and the reduced diameter for receiving a pin 166 that secures the two portions together. A compression spring 168 is arranged on the reduced diameter 160 with a pair of thrust washers 170 on opposite sides of the spring. The spring urges one of the washers 170 against an end 172 of the second portion 158 and the other washer 170 against a shoulder 172 formed by the reduced diameter 160. The block 74 includes an enlarged bore 176 having a bottom shoulder 178, as best seen in FIG. 7, that contains the spring 168 and thrust washers 170 with clearance. One of the thrust washers 170 which is of larger diameter that the diameter of the shaft porion 156, lightly abuts against the bottom shoulder 178. A retaining plate 180 having an open ended slot 182 formed therein is attached to the block 74 by means of two screws 184 that extend through clearance holes 186 in the plate 180 and into threaded holes 188 in the block 74. The width of the slot 182 is sufficient to clear the diameter of the shaft portion 158 but is smaller than the diameter of the thrust washer 170. The depth of the bottom shoulder 178 is chosen so that the two thrust washers 170 are in light engagement with bottom shoulder 178 and the retaining plate 180 without appreciably further compressing the spring 168. With this arrangement the shaft 24 may be moved axially in a first direction, indicated by the arrow 190, where the spring 168 undergoes compression between the shoulder 174 and the retaining plate 180, and a second opposite direction, indicated by the arrow 192, where the spring 168 undergoes compression between the end 172 and the bottom shoulder 178. When the shaft 24 is released it will return to a first neutral position, as shown in FIG. 7.

Figure 17:
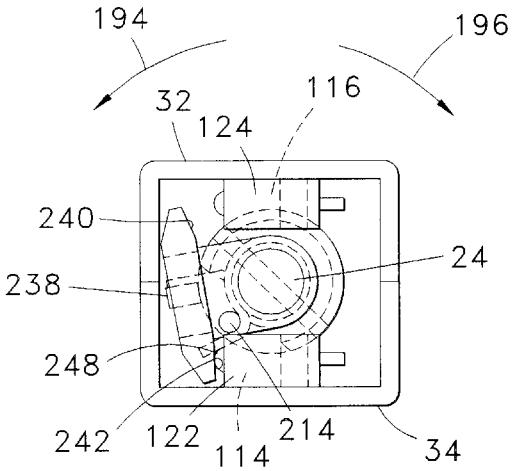
FIGS. 17, 18, and 19 are cross-sectional views taken along the lines 17—17, 18—18, and 19—19, respectively, in FIG. 7.
Figure 18:
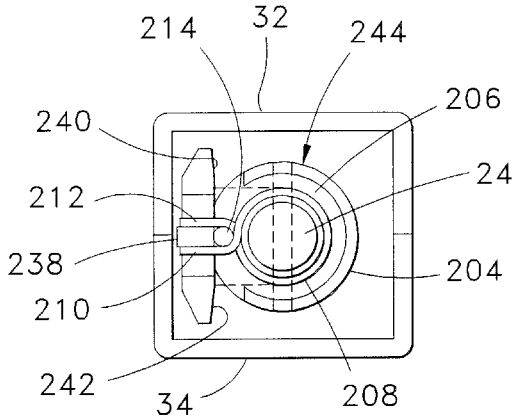
Figure 19:
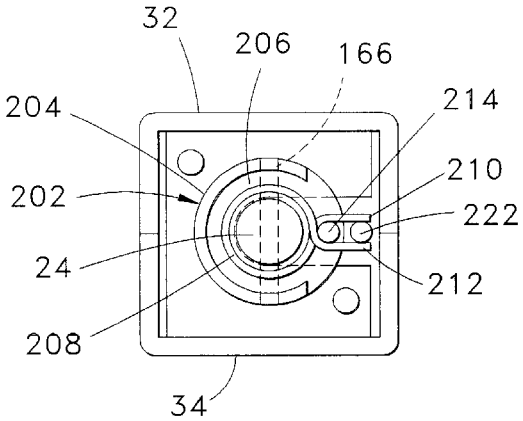
Figure 19A:
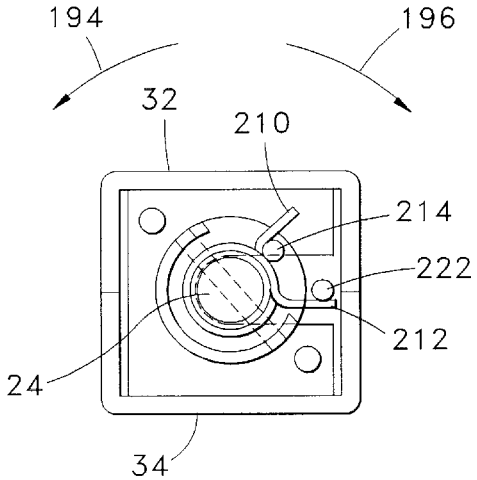
FIG. 19A is a view similar to that of FIG. 19 showing the shaft rotated.

In addition to axial movement the shaft 24 may undergo rotational movement in a third direction clockwise, indicated by the arrow 194, and in a fourth opposite direction counterclockwise, indicated by the arrow 196, as shown in FIG. 5. This rotational movement in the third and fourth directions occurs with respect to a second neutral position of the shaft 24 as shown in FIGS. 7 and 18. Note that FIG. 18, as well as FIGS. 17, 19, and 19A, are taken in a direction opposite to that of FIG. 5 so that the arrows 194 and 196 shown in these figures are reversed with respect to the arrows shown in FIG. 5. A return spring assembly 202, as shown in FIGS. 7, 10, and 19, includes a cylindrically shaped housing 204 that is attached to the shaft 24 by means of the pin 166. The housing 204 includes a recess 206 containing a torsion spring 208 which wraps around the shaft 24 and terminates in two legs 210 and 212. The torsion spring has been deflected so that the two legs 210 and 212 are urged toward each other and against a pin 214 that extend through a hole 216 in the housing 204 and into the recess 206. A washer 218 abuts against the open end of the housing 204 to encloses the recess thereby retaining the torsion spring 208 inside the recess. A retaining ring 220 is disposed in a groove formed in the shaft 24 for holding the washer 218 against the housing 204. Another pin 222 extend from the block 74 and between the two legs 210 and 212, as shown in FIGS. 7 and 19. Therefore, when the shaft 24 is rotated from its second neutral position, shown in FIG. 19, in the third direction 194, as shown in FIG. 19A, the leg 210 is forced away from the leg 212 by the pin 214 thereby elastically deflecting the torsion spring. When the shaft is released, the leg 210 returns the shaft to its second neutral position. Similarly, when the shaft 24 is rotated in the fourth direction 196 from its second neutral position, not shown, the leg 212 is forced away from the leg 210 by the pin 214 thereby elastically deflecting the torsion spring. When the shaft is again released, the leg 212 returns the shaft to its second neutral position shown in FIG. 19.

Figure 11:
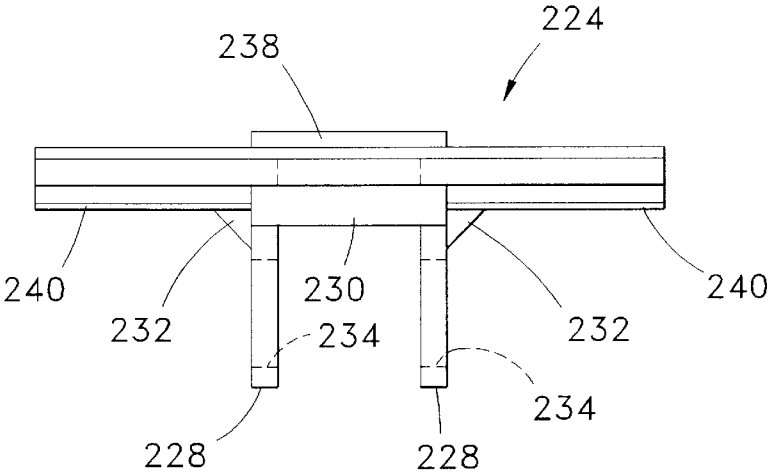
FIGS. 11, 12, and 13 are side, end, and bottom views, respectively, of the rotational cam actuating member shown in FIG. 7.
Figure 12:
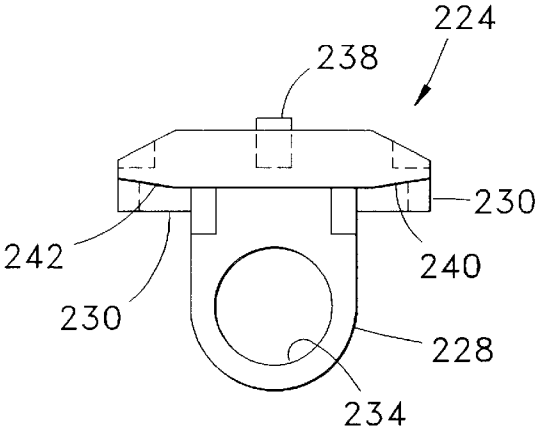
Figure 13:
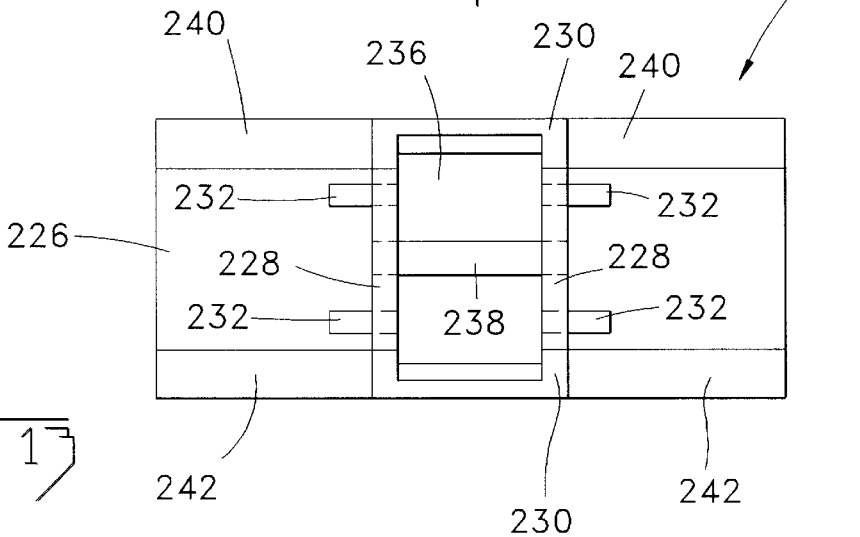

A rocker cam 224, as best seen in FIGS. 11, 12, and 13, includes a main body 226 having a pair of spaced apart flanges 228 extending from one side thereof and strengthened by two U-shaped support rails 230 and four gussets 232. A bore 234 extends through the two flanges 228 and is sized to be a loose slip fit with the outside diameter of the shaft 24. A rectangular shaped opening 236 is formed through the body 226 between the two flanges 228. A rectangularly shaped bar 238 straddles the center of the opening 236, as shown in FIG. 13, and is attached at each end to the body 226. By way of example, the entire rocker cam 224 may be molded from any suitable material such as NYLATRON, which is a graphite reenforced nylon manufactured by DSM Engineering Plastics of Evensville, Ind. 47720. Upper and lower actuating surfaces 240 and 242, respectively, are formed along opposite edges of the body on each side of the U-shaped rails 230, the purpose of which will be explained below. The rocker cam 224 is positioned on the shaft 24, as shown in FIGS. 7 and 10, with a second retaining spring assembly 244 arranged between the two flanges 228. The retaining spring assembly 244 is identical to the retaining spring assembly 204 wherein similar parts of the two assemblies are identified with like numbers. The retaining spring assembly 244 has its housing 204 attached to the shaft 24 by means of a pin 246 that extends through the housing 204 and shaft 24. The spacing between the two flanges 228 is chosen to loosely receive the retaining spring assembly 202 and to allow free rotation of the rocker cam 224 with respect to the shaft 24. The two legs 210 and 212 are urged against opposite sides of the bar 238 by the torsion spring 208, as shown in FIG. 18. The torsion spring of the second retaining spring assembly 244 is as shown in FIG. 18 when the shaft 24 is in the second neutral position, as shown in FIGS. 7 and 19. As the shaft 24 is rotated in the third direction 194, as shown in FIG. 17, the pin 214 causes the leg 210 to rotate in the same direction and the leg 212, under the urging of the torsion spring 208, pushes against the bar 238 so that the entire rocker cam 224 is made to rotate in the third direction. Rotation of the rocker cam 224 continues until the lower actuating surface 242 engages the plungers 248 of the third and seventh switches 114 and 122, respectively, and actuates the switch element of these switches. If rotation of the shaft 24 continues in the third direction, the pin 214 simply deflects the leg 210 away from the bar 238, as shown in FIG. 17, while the rocker cam 224 remains where it is in engagement with the switches 114 and 122. This serves as an override safety so that over rotation of the shaft will not damage the delicate mechanism of the switch assembly 22. When the shaft 24 is released it rotates back to its second neutral position shown in FIG. 19 while the rocker cam 224 rotates back to its neutral position shown in FIGS. 7 and 18.

Figures 14, 15, 16, 20, 21:
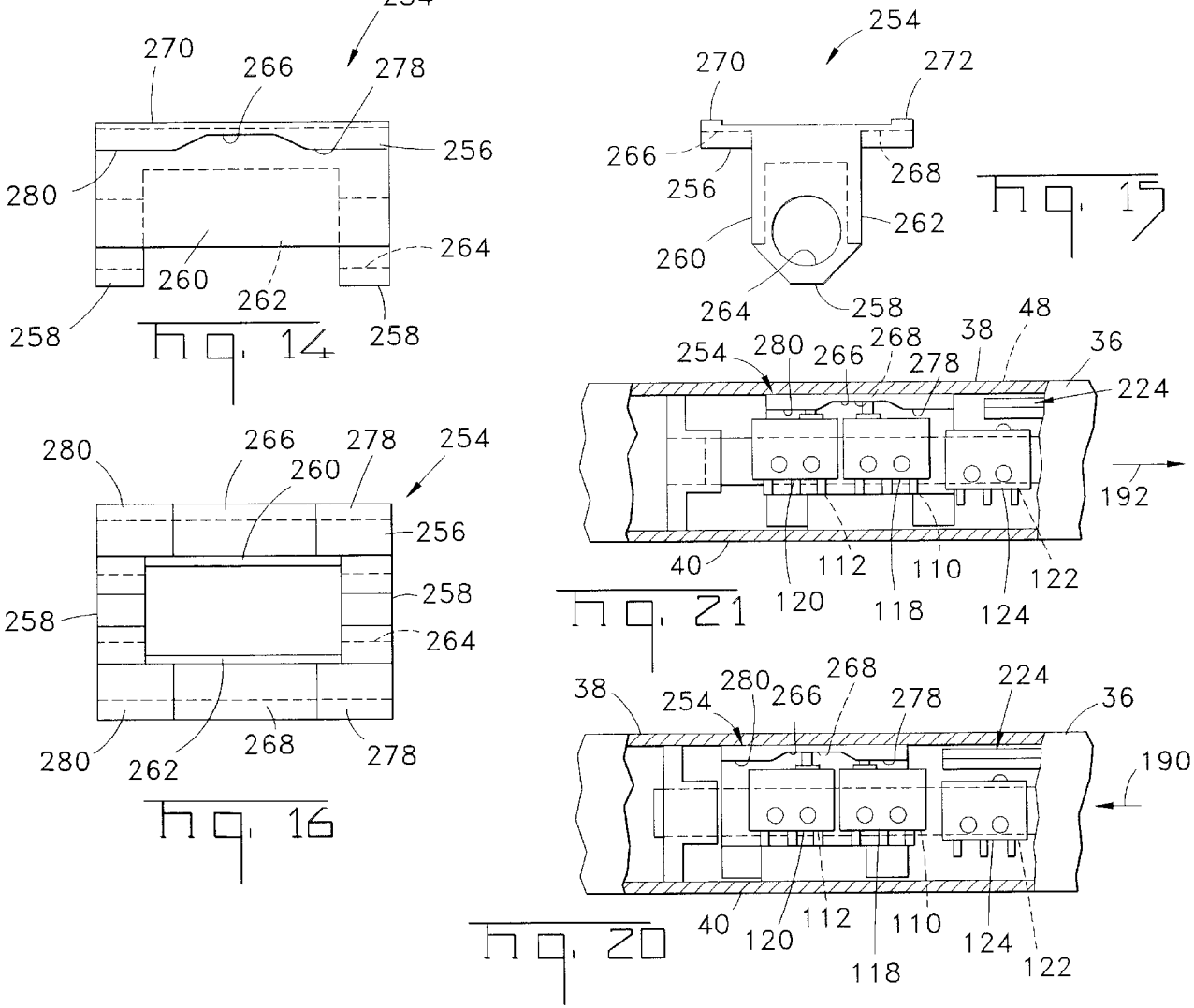
FIGS. 14, 15, and 16 are side, end, and bottom views, respectively, of the linear moving cam actuating member shown in FIG. 7.
FIG. 20 is a plan view of a portion of the switch assembly shown in FIG. 3, with a portion of the upper wall removed showing the linear cam in one position.
FIG. 21 is a view similar to that of FIG. 20 showing the linear cam in a different position.

A linear cam 254, as best seen in FIGS. 14, 15, and 16, includes a base 256 and a pair of spaced flanges 258 extending therefrom interconnected by upper and lower wall segments 260 and 262, respectively. A bore 264 extends through the two flanges 258 and is sized to be a loose slip fit with the outside diameter of the shaft 24. By way of example, the entire linear cam 254 may be molded from any suitable material such as NYLATRON which has been described above. Upper and lower camming surfaces 266 and 268, respectively, are formed along opposite sides of the base 256 adjacent the upper and lower wall segments 260 and 262 for a purpose that will be explained below. Upper and lower guide rails 270 and 272, respectively, extend from the base 256 on a side opposite the upper and lower camming surfaces 266 and 268, respectively, as best seen in FIGS. 14 and 15. These guide rails 270 and 272 lightly engage the inside surface of the right side wall 48, as shown in FIG. 7. A pair of grooves 276 are formed in the shaft 24, as best seen in FIG. 8, and are positioned on opposite sides of the linear cam 254, as shown in FIGS. 7 and 10. A pair of retaining rings 274 are arranged in the two grooves so that the linear cam 254 cannot move axially with respect to the shaft 24, yet the shaft is free to rotate within the bore 264 without rotating the linear cam. During such rotation of the shaft 24 the linear cam 254 is prevented from rotating by engagement of the guide rails 270 and 272 with the inside surface of the right side wall 48, as shown in FIG. 7. However, as the shaft is moved axially in the directions of the arrows 190 and 192, the linear cam 254 is moved along with the shaft, the guide rails 270 and 272 sliding along the surface of the wall 48.

As shown in FIGS. 20 and 21 the linear cam 254 is positioned on the shaft 24 so that when the shaft is moved from its first neutral position, shown in FIG. 7, axially in the direction 190, the linear cam 254 is moved to the position shown in FIG. 20 where the cam surfaces 266 and 168 have moved the actuating plungers of the switches 110 and 118 inwardly to actuate the switches. Note that the actuating plungers of the two switches are now riding on flat overrun surfaces 278 so that further axial movement of the shaft 24 will not damage the mechanism. Similarly, when the shaft is moved from its first neutral position, shown in FIG. 7, axially in the direction 192, the linear cam 254 is moved to the position shown in FIG. 21 where the cam surfaces 266 and 168 have moved the actuating plungers of the switches 112 and 120 inwardly to actuate the switches. Similar to the previous position, the actuating plungers of the two switches are now riding on flat overrun surfaces 280 so that further axial movement of the shaft 24 will not damage the mechanism.

In operation, the shaft 24 may be moved in any possible combination of the directions 190, 192, 194, and 196 to actuate either individual switches or a combination of them. For example, axial movement of the shaft 24 only in the direction 190 will actuate only the switches 110 and 118, while axial movement only in the direction 192 will actuate only the switches 112 and 120. Similarly, rotational movement of the shaft 24 only in the direction 194 will actuate only the switches 114 and 122, while rotational movement only in the direction 196 will actuate only the switches 116 and 124. Suitable combinations of these movements will actuate corresponding combinations of switches. For example, both axial and rotational movement of the shaft in the directions 190 and 194, respectively, will actuate the combination of switches 110, 118, 114, and 122. Other suitable combinations of axial and rotational movement of the shaft 24 will result in the actuation of switches 112, 120, 114, and 122; 110, 118, 116, and 124; and 112, 120, 116, and 124. Each of these different combinations of switch actuations may result in the initiation of a different function by the traffic flow system.

While the completely enclosed structure of the housing 30 advantageously serves to reduce the exposure of the switches to dust and other contaminants, it will be understood that the housing 30 may be constructed without the left and right side walls 38, 48, 40, and 50 as long as the upper and lower walls 36 and 46 are adequately supported by the block 74 and the closed ends 58 and 60. It will be appreciated by those skilled in the art that the compact structure of the switch assembly 22 is made possible partly by the attachment of the switches to the upper and lower walls 36 and 46. Further, it will be understood that the teachings of the present invention may be practiced without the backup switches 118, 120, 122, and 124 and the backup control system 128 in the event that such backup is not desired. Alternatively, the backup switches may be used for redundancy or for other purposes. While the present switch assembly 22 is illustrated with respect to a mosaic panel, it will be understood that the switch assembly may be used with other suitable panel structures.

An important advantage of the present invention is that the multi-function switch assembly is small enough to be mounted within the confines of a single tile so that adjacent tiles may concurrently accommodate switch assemblies, thereby enabling a relatively high switch density in any desired location on the panel. Further, the switch elements are separately completely enclosed to prevent contamination of the contacts and they have a snap action to provide superior electrical contact and increased reliability and service life. Further, the switch assembly contains both primary and backup switches having individual electrically isolated switch elements to accommodate both the primary functions that are communicated through the computer control system as well as a backup control system, thereby obviating the need for separate relay switching circuits.

We claim:

1. A momentary switch assembly for use in a control panel comprising:

(1) an elongated housing having at least two side walls and ends defining an interior cavity;

(2) a shaft extending through one of said ends and into said interior cavity along a longitudinal axis, said shaft arranged to move axially in a first direction with respect to said housing from a first neutral position and in a second opposite direction from said first neutral position, and to rotate about said axis in a third direction with respect to said housing from a second neutral position and in a fourth opposite direction from said second neutral position;

(3) first and second mutually independent electrical switches, each of which is attached to one of said side walls of said housing within said cavity and coupled to said shaft by a first coupling so that movement of said shaft in said first direction actuates only said first switch and movement of said shaft in said second direction actuates only said second switch;

(4) third and fourth mutually independent electrical switches, each of which is attached to one of said side walls of said housing within said cavity and coupled to said shaft by a second coupling so that movement of said shaft in said third direction actuates only said third switch, and movement of said shaft in said fourth direction actuates only said fourth switch; and (5) means for urging said shaft into said first and second neutral positions.

2. The switch assembly according to claim 1 wherein said third and fourth mutually independent electrical switches are attached to separate walls of said side walls of said housing.

3. The switch assembly according to claim 1 wherein said third and fourth mutually independent electrical switches are attached to opposite walls of said side walls of said housing.

4. The switch assembly according to claim 1 wherein said first coupling comprises a first member carried by and moved with said shaft only when said shaft undergoes movement in said first and second directions, said first member having a first actuating surface that effects said actuation of only said first switch upon said movement in said first direction, and a second actuating surface that effects said actuation of only said second switch upon said movement in said second direction.

5. The switch assembly according to claim 4 wherein said first member includes an alignment surface in spaced sliding engagement with one of said side walls arranged to prevent movement of said first member in both said third or fourth directions upon movement of said shaft in said third and fourth directions.

6. The switch assembly according to claim 5 wherein said shaft extends through an opening disposed in said first member and includes stop means for preventing axial movement of said first member with respect to said shaft.

7. The switch assembly according to claim 1 wherein said second coupling comprises a second member carried by and moved with said shaft, said second member having a third actuating surface that effects said actuation of said third switch upon said movement of said shaft in said third direction, and a fourth actuating surface that effects said actuation of said fourth switch upon said movement of said shaft in said fourth direction.

8. The switch assembly according to claim 7 wherein said shaft extends through an opening disposed in said second member and said second coupling includes a resilient member rotationally coupling said second member to said shaft so that upon movement of said shaft in said third direction said resilient member moves said second member in said third direction into actuating engagement with said third switch and upon further movement of said shaft in said third direction said second member stops its movement thereby causing said resilient member to undergo deflection during said further movement of said shaft in said third direction.

9. The switch assembly according to claim 8 wherein said resilient member is arranged so that upon movement of said shaft in said fourth direction said resilient member moves said second member in said fourth direction into actuating engagement with said fourth switch and upon further movement of said shaft in said fourth direction said second member stops its movement thereby causing said resilient member to undergo deflection during said further movement of said shaft in said fourth direction.

10. The switch assembly according to claim 9 wherein said resilient member is a torsion spring encircling said shaft.

11. The switch assembly according to claim 1 wherein each of said first, second, third, and fourth electrical switches is contained in a separate housing exclusive from the housings of the other of said electrical switches.

12. The switch assembly according to claim 1 wherein said at least two side walls comprise four side walls and said interior cavity is substantially completely enclosed.

13. The switch assembly according to claim 1 wherein upon movement of said shaft in a selected combination of said first, second, third, and fourth directions a corresponding combination of first, second, third, and fourth switches are actuated.

14. The switch assembly according to claim 1 wherein said means for urging said shaft into said first neutral position comprises a compression spring encircling a portion of said shaft and having two opposite ends disposed between a surface attached to said shaft and another surface attached to said housing.

15. The switch assembly according to claim 14 wherein said surface attached to said shaft and said another surface are spaced apart a distance substantially equal to or slightly greater than the distance between said two opposite ends of said spring when said spring is in a free state.

16. The switch assembly according to claim 1 wherein said means for urging said shaft into said second neutral position comprises: a torsion spring encircling a portion of said shaft, said torsion spring having first and second end portions arrange substantially mutually parallel and spaced apart; an actuating pin attached to said shaft and extending between said first and second end portions; and a fixed member attached to said housing and extending between said first and second end portions, said torsion spring arranged so that upon movement of said shaft in one of said third and fourth directions and away from said second neutral position said pin moves one of said first and second end portions away from the other end portion thereby elastically deflecting said torsion spring, and upon release of said shaft said one of said first and second end portions urges said pin and shaft in the other of said third and fourth directions so that said shaft moves back to said second neutral position.

17. The switch assembly according to claim 1 including an override means for permitting continued movement of said shaft in said third and fourth directions after said actuation of said third and forth switches, respectively.

18. The switch assembly according to claim 9 wherein said override means comprises: a torsion spring encircling a portion of said shaft, said torsion spring having first and second end portions arrange substantially mutually parallel and spaced apart; an actuating pin attached to said shaft and extending between said first and second end portions; and a fixed rib attached to said second member and extending between said first and second end portions.

19. The switch assembly according to claim 1 including:

(1) fifth and sixth mutually independent electrical switches, each of which is attached to one of said side walls of said housing within said cavity and coupled to said shaft by a third coupling so that movement of said shaft in said first direction actuates only said first and fifth switches and movement of said shaft in said second direction actuates only said second and sixth switches; and (2) seventh and eighth mutually independent electrical switches, each of which is attached to one of said side walls of said housing within said cavity and coupled to said shaft by a fourth coupling so that movement of said shaft in said third direction actuates only said third and seventh switches, and movement of said shaft in said fourth direction actuates only said fourth and eighth switches.

20. The switch assembly according to claim 19 wherein said first and third couplings are a single coupling and said second and fourth couplings are another single coupling.

21. A momentary switch assembly for use in a control panel comprising:

(1) an elongated housing having at least two side walls and ends defining an interior cavity;

(2) a shaft extending through one of said ends and into said interior cavity along a longitudinal axis, said shaft arranged to move axially in a first direction with respect to said housing from a first neutral position and in a second opposite direction from said first neutral position, and to rotate about said axis in a third direction with respect to said housing from a second neutral position and in a fourth opposite direction from said second neutral position;

(3) a first plurality of mutually independent electrical switches, each of which is attached to one of said side walls of said housing within said cavity and coupled to said shaft by a first coupling so that movement of said shaft in said first direction actuates only some of said first plurality of switches and movement of said shaft in said second direction actuates only others of said first plurality of switch;

(4) a second plurality of mutually independent electrical switches, each of which is attached to one of said side walls of said housing within said cavity and coupled to said shaft by a second coupling so that movement of said shaft in said third direction actuates only some of said second plurality of switches, and movement of said shaft in said fourth direction actuates only others of said second plurality of switches; and (5) means for urging said shaft into said first and second neutral positions.

22. The switch assembly according to claim 21 wherein some of said first plurality of switches are primary switches and others of said first plurality of switches are backup switches.

23. The switch assembly according to claim 21 wherein said first coupling comprises a first member carried by and moved with said shaft only when said shaft undergoes movement in said first and second directions, said first member having a first actuating surface that effects said actuation of only said first switch upon said movement in said first direction, and a second actuating surface that effects said actuation of only said second switch upon said movement in said second direction.

24. The switch assembly according to claim 23 wherein said first member includes an alignment surface in spaced sliding engagement with one of said side walls arranged to prevent movement of said first member in both said third or fourth directions upon movement of said shaft in said third and fourth directions.

25. The switch assembly according to claim 24 wherein said shaft extends through an opening disposed in said first member and includes stop means for preventing axial movement of said first member with respect to said shaft.

26. The switch assembly according to claim 21 wherein said second coupling comprises a second member carried by and moved with said shaft, said second member having a third actuating surface that effects said actuation of said third switch upon said movement of said shaft in said third direction, and a fourth actuating surface that effects said actuation of said fourth switch upon said movement of said shaft in said fourth direction.

27. The switch assembly according to claim 26 wherein said shaft extends through an opening disposed in said second member and said second coupling includes a resilient member rotationally coupling said second member to said shaft so that upon movement of said shaft in said third direction said resilient member moves said second member in said third direction into actuating engagement with said third switch and upon further movement of said shaft in said third direction said second member stops its movement thereby causing said resilient member to undergo deflection during said further movement of said shaft in said third direction.

28. The switch assembly according to claim 27 wherein said resilient member is arranged so that upon movement of said shaft in said fourth direction said resilient member moves said second member in said fourth direction into actuating engagement with said fourth switch and upon further movement of said shaft in said fourth direction said second member stops its movement thereby causing said resilient member to undergo deflection during said further movement of said shaft in said fourth direction.

* * * * *